US010077630B2

(12) United States Patent
Hawkins, III

(10) Patent No.: US 10,077,630 B2
(45) Date of Patent: Sep. 18, 2018

(54) PILOT INSIDE A BALL SUITABLE FOR WELLBORE OPERATIONS

(71) Applicant: Drilling Innovative Solutions, LLC, Lafayette, LA (US)

(72) Inventor: Samuel P. Hawkins, III, Scott, LA (US)

(73) Assignee: Drilling Innovative Solutions, LLC, Lafayette, LA (US)

( * ) Notice: Subject to any disclaimer, the term of this patent is extended or adjusted under 35 U.S.C. 154(b) by 221 days.

(21) Appl. No.: 14/880,929

(22) Filed: Oct. 12, 2015

(65) Prior Publication Data

US 2017/0101848 A1 Apr. 13, 2017

(51) Int. Cl.
*E21B 21/10* (2006.01)
*E21B 34/10* (2006.01)
*E21B 34/00* (2006.01)

(52) U.S. Cl.
CPC ..... *E21B 34/10* (2013.01); *E21B 21/10* (2013.01); *E21B 2034/002* (2013.01)

(58) Field of Classification Search
CPC ..... E21B 21/10; E21B 34/10; E21B 2034/002
See application file for complete search history.

(56) References Cited

U.S. PATENT DOCUMENTS 3,870,101 A 3/1975 Helmus
4,220,176 A * 9/1980 Russell ..... E21B 21/10 137/496
4,254,836 A * 3/1981 Russell ..... E21B 21/10 137/12
4,846,221 A * 7/1989 Kanemaru ..... F16K 5/0605 137/514
5,553,672 A * 9/1996 Smith, Jr. ..... E21B 43/10 166/120
6,401,824 B1 6/2002 Musselwhite et al.
6,679,336 B2 1/2004 Musselwhite et al.
6,866,100 B2 * 3/2005 Gudmestad ..... E21B 34/06 166/166
8,074,718 B2 * 12/2011 Roberts ..... E21B 23/04 166/319
9,222,334 B2 * 12/2015 Erkol ..... E21B 34/06
2006/0272825 A1 * 12/2006 Royer ..... E21B 34/14 166/373
2008/0196903 A1 8/2008 Wardley et al.
2011/0266472 A1 * 11/2011 Russell ..... E21B 21/106 251/28
2013/0000917 A1 1/2013 Slack et al.
(Continued)

*Primary Examiner* — Matthew R Buck

(57) ABSTRACT

An apparatus, system, and method of use enable control of fluid flow in a wellbore tubular. The apparatus comprises a pusher rod with a bore for fluid flow contacting a rotatable ball with an internal bore comprising at least one pilot, wherein the seat between the pusher rod and the interior of the tubular prevents fluid flow. Pressure changes on the pusher rod rotate the bore of the ball in and out of contact with the bore of the pusher rod, to enable or prevent fluid flow, respectively. A method of use opens the ball by exerting pressure and/or force on the pusher rod to enable fluid through the ball by aligning the internal bores. Fluid flow is stopped by pressure exerted on the bottom of the ball causing the ball to rotate whereby the internal bore of the pusher rod is connected to the exterior surface of the ball.

20 Claims, 5 Drawing Sheets

(56) References Cited

U.S. PATENT DOCUMENTS

| | | | | |
|---|---|---|---|---|
| 2013/0025711 | A1* | 1/2013 | Russell | E21B 21/10<br>137/512 |
| 2013/0082202 | A1* | 4/2013 | Morrison | E21B 33/14<br>251/315.01 |
| 2014/0144526 | A1* | 5/2014 | Russell | F16K 15/18<br>137/512.2 |

* cited by examiner

PILOT INSIDE A BALL SUITABLE FOR WELLBORE OPERATIONS

FIELD

The present invention relates, in general, to an apparatus, system and method for controlling fluid flow inside a tubular in a wellbore. More particularly, the invention relates to a pilot inside a ball for controlling fluid flow in subterranean environments during hydrocarbon operations, including oil and gas wells.

BACKGROUND

The oil and gas industry utilizes check valves for a variety of applications, including oil and gas wellbore operations. A check valve is a mechanical device that permits fluid to flow, or pressure to act, one-way or in one direction only. Check valves are utilized in oil and gas industry applications, in particular involving fluid control and safety. Check valves can be designed for specific fluid types and operating conditions. Some designs are tolerant of debris, whereas others may obstruct the bore of the conduit or tubing in which the check valve is fitted. Conventional check valves are known to have reliability issues due to wear problems. This is a consequence of flow for an open valve continually passing both the seat and the sealing plug or ball of those check valves. These reliability issues lead to valve failure, particularly in abrasive flow applications or when larger objects flow through the valve. Oilfield operations can cause conventional pilots (mechanisms designed to restrict and guide fluid flow, e.g., poppet valves, ball valves, flapper valves, and chokes) to leak due to corrosion of the seat and valve during the operations. The use of check valves is important in the oil & gas industry as reliable check valves can protect against loss of well control, including well blowouts.

A check valve should be engineered to be operable in high stress and vibration environments, including casing operations in a wellbore that increase wear on the constituent valve components. The wear problem is compounded in abrasive environments, such as oilfield cements, muds or slurries.

In general, check valves are typically used immediately above the casing ends or joints in oilfield casing, and is typically termed a "float valve" or "float collar" respectively. While all components in a casing string are subject to relatively high vibrations, float valves are exposed to very high vibrations, including accelerations of up to 10 g (gravity) or more while flow passes, often in excess of 600 gallons per minute. Relative motion of the adjacent parts on wellbore equipment in the abrasive subterranean fluid environment increases wear on the wellbore equipment, which can cause misalignment between a sealing member of a valve and its valve seat.

Oil and gas operation check valves, as disclosed by U.S. Pat. Nos. 3,870,101, 6,401,824, 6,679,336, and U.S. Patent Application Nos. 2013/0082202 and 2014/0144526 utilize pilots to control fluid flow in high vibration oil and gas operations. However, these check valve devices suffer from corrosion on the seats and seals located inside the valves, due to the abrasive action of direct fluid flow as discussed above.

There is a need for a more reliable check valve that is designed to improve reliability by reducing corrosion from direct fluid flow on the seat and/or seals of the check valve.

Embodiments usable within the scope of the present disclosure meet these needs.

SUMMARY

The present disclosure is directed to a valve and method of use therefor, suitable for use in subterranean casing. In an embodiment, the valve comprises a ball sized to fit inside a tubular body. The tubular body comprises a bore for fluid flow inside the tubular body, with a ball located within the bore of the tubular body. The ball itself also comprises a bore, with at least one pilot within the bore of the ball permitting one-way fluid flow. The contact between the inner surface of the tubular body bore and the ball can define a seat, wherein the seat prevents fluid flow between the ball and the tubular body. In this embodiment, a pusher rod contacts the ball. The pusher rod can comprise a cylindrical shape having a first end and a second end connected by an internal bore, located between the first end and the second end and having an internal diameter. This internal diameter may increase toward the first end opening and the second end opening (i.e., a dual funnel configuration) with at least one opening shaped to match a corresponding exterior contour and diameter of the ball. Rotation of the bore of the ball away from the internal diameter of the pusher rod prevents fluid flow through the ball, while rotation of the bore of the ball in alignment to the internal diameter of the pusher rod permits one-way fluid flow. The pusher rod and the bore of the tubular body may additionally comprise at least one seal to prevent fluid flow between the pusher rod and the bore of the tubular body.

The present disclosure is further directed to a method for controlling fluid flow inside a wellbore. In one embodiment, the method comprises the steps of inserting a tubular device with a bore for fluid flow into a wellbore. The tubular device comprises a ball designed to fit inside the tubular device, and the ball comprises a bore with at least one pilot. The apparatus additionally comprises a pusher rod contacting the ball, wherein the pusher rod comprises a cylindrical shape, a first end opening and a second end opening. These openings are connected by an internal bore therebetween having an internal diameter. The inside of the tubular body can comprise at least one seal to prevent fluid flow between the pusher rod and the inside of the tubular device. In this embodiment, the method further comprises "opening" the ball by exerting pressure on the pusher rod to enable fluid flow therethrough by aligning the internal bore of the pusher rod with the internal bore of the ball and pressurizing fluid through the pilot into the wellbore below the tubular device. The method also enables cessation of fluid flow by decreasing pressure on the pusher rod, causing the ball to rotate until the internal bore of the pusher rod is aligned with the exterior surface of the ball.

The present disclosure is further directed to a system for controlling fluid flow movement inside wellbore tubulars. The fluid flow system comprises a ball designed to fit inside a tubular body, and the tubular body comprises a bore for fluid flow inside the tubular body. In this embodiment, the ball comprises a bore, with at least one pilot inside the bore of the ball permitting one-way fluid flow. The ball can rotatably fit inside the tubular body and the intersection of the bore of the tubular body and the ball can define a seat. The seat prevents fluid flow between the ball and the tubular body.

In this embodiment of the system for controlling fluid flow, a pusher rod, comprising a cylindrical shape having a first end and a second end connected by an internal bore therebetween, contacts the ball. The internal diameter of the internal bore of the pusher rod can increase from the center towards the first end opening and the second end opening, to match a corresponding exterior contour of the ball. Rotation of the bore of the ball away from the internal bore of the pusher rod prevents fluid flow through the ball, while rotation of the bore of the ball in alignment with the internal bore of the pusher rod permits one-way fluid flow. The pusher rod and the inside of the tubular body can comprise at least one seal to prevent fluid flow therebetween. A control device selectively controls the opening of the pilot through fluid flow and controls the closing of the ball through pressure exerted on the pusher rod.

The foregoing is intended to give a general idea of the invention, and is not intended to fully define nor limit the invention. The invention will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

Figure 1:
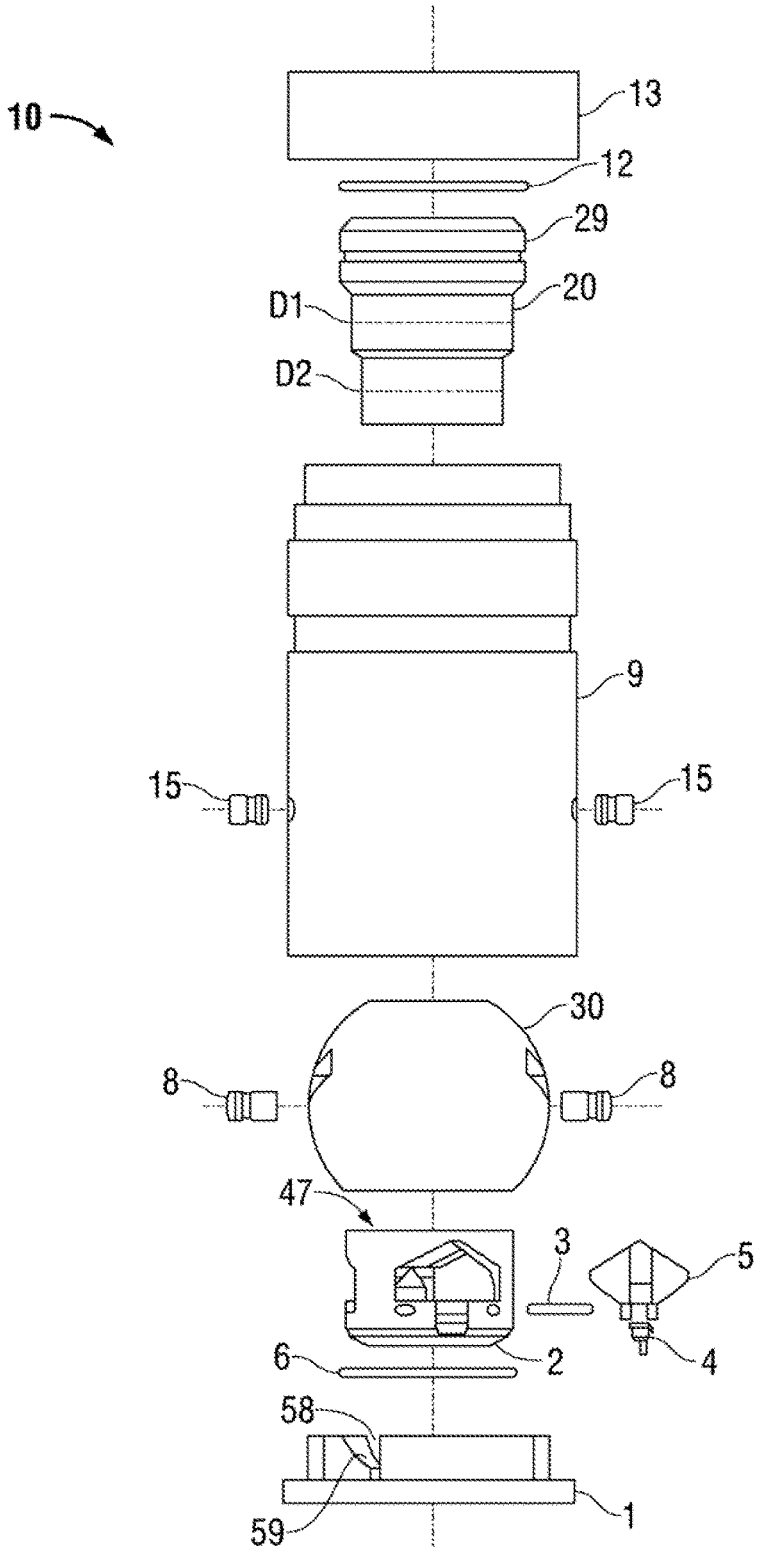
FIG. 1 depicts a schematic of the ball pilot apparatus according to one embodiment in accordance with the present disclosure.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

In general, an embodiment of the valve system is directed to an apparatus, system and method for controlling fluid flow inside well tubulars within a wellbore. The valve can be operated by selective control of pressure and fluid flow by utilizing a ball sized to fit inside the bore of a housing. At least one (and up to ten) pilots (e.g., flapper valves) may be engineered to fit inside the ball. The ball has a generally round profile with an internal bore therethrough permitting internal fluid flow through a tubular, or other wellbore tool, with the pilot(s) allowing one-way fluid flow.

A pilot is any device that can restrict or prevent fluid flow in at least one direction. Examples of pilots include, but are not limited to: flapper valves, selective membranes, one-way valves, poppet valves, ball valves (i.e., a secondary ball-in-ball construction), pressure valves, chokes, or combinations thereof. Persons skilled in the art will recognize additional devices that can restrict fluid flow in one direction and are suitable for use as a pilot alongside the present invention. For purposes of brevity, the bulk of the present disclosure describes an embodiment utilizing a flapper valve pilot, which is not meant to be limiting.

In an embodiment, the ball is designed to rotate against a seat, inside the housing, against a pusher rod on top. The pusher rod has a generally cylindrical shape with two ends connected by an internal bore of the pusher rod, with the internal diameter of the pusher rod permitting fluid flow between the two ends. The pusher rod has a funnel top shape with the cylindrical top end angled outward toward the first end opening for favorable fluid flow, with the second end also angled outward toward the second end opening to match the corresponding exterior contour of the ball. In one embodiment, the angle of the second end opening matching the exterior contour of the ball prohibits any fluid flow, or at least prohibits direct fluid flow, outside of the respective bores of the ball and pusher rod. The rotation of the ball seals off fluid flow by rotating the internal bore of the ball away from the internal bore of the pusher rod.

In an embodiment, the design of the pusher rod and the ball allows fluid flow without any fluid contacting the seals and/or seats where the ball contacts the housing. This design allows for greater fluid flow, including mud flow, without the seals and/or seat being worn or damaged by the impact of said fluid flow.

In one embodiment, the pusher rod can have an exterior diameter and an O-ring seal on the exterior diameter of the pusher rod to contour, or match, a corresponding interior diameter of the housing, and thus prevent fluid flow outside of the pusher rod. In one embodiment, the seal on the exterior of the pusher rod is protected from fluid flow by the shape of the exterior diameter, wherein the seal is below a section that extrudes outwardly to match the contour of the ball. The valve is designed to both permit and prevent fluid flow without any fluid flow contacting the seat and seals, such as the seal on the exterior of the pusher rod. In a float shoe embodiment, the ball with the pilot device is placed inside a drillable nose cone of a float shoe to facilitate fluid flow through the float shoe.

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the fluid control apparatus, system and method in accordance with the present disclosure can comprise all of the features described above. However, it should also be understood that each feature described above can be incorporated into the valve apparatus 10, the ball 30 and pusher rod 20 by itself or in combination, without departing from the scope of the present disclosure, as shown in FIG. 1.

FIG. 1 illustrates an embodiment of the apparatus 10 showing a ball 30 containing the pilot housing 2 and contacting the pusher rod 20. The ball 30 has an internal bore 31 in the center (not visible in FIG. 1) containing pilot housing 2. The pilot housing 2 in turn has an internal bore 47 for fluid flow containing a pilot 5 (shown in this embodiment as a flapper valve) that is connected to the pilot housing 2 by pin 3 and spring mechanism 4, in the embodiment shown in FIG. 1. In this embodiment, ball 30 is inserted into a housing 9 through the use of two ball center pins 8 that can be inserted into lugs 15 in the housing 9, as shown in FIG. 1. The ball center pins 8 and corresponding lugs 15 permit pivoting, or rotational movement, of the ball 30 inside the housing 9. The ball 30 and pilot housing 2 are also held firmly in place by a lower ball stop 1 and a ball retainer ring 6 between the pilot housing 2 containing the ball 30 and lower ball stop 1. Lower ball stop 1 features gaps 58 and curves 59 on the interior wall sections, which can help direct debris toward the opening 51 of the bore 52 (not visible in FIG. 1). In an embodiment, the housing 9 can be a tubular or a modified joint of pipe that can be used in a wellbore.

The pusher rod 20 is cylindrically shaped with an internal bore 21 (not visible in FIG. 1) and is designed to move and/or pivot inside the housing 9. The area of contact between the exterior of the pusher rod 20 and/or the ball 30 and the interior of the housing 9 is known as the seat 60 (not visible in FIG. 1). As further shown in FIG. 1, the pusher rod 20 typically has a section with a larger exterior diameter D1 for contacting the interior of the housing 9, while the section contacting the ball 30 has a diameter D2 less than the larger exterior diameter D1. In the depicted embodiment, the section of the housing 9 with diameter D1 is depicted with a groove 29 for receiving a seal such as an O-ring 12 that can be used to seal the contact between the exterior of the pusher rod 20 and the interior of the housing 9 in order to prevent any fluid flow into the seat. Also in the depicted embodiment, the pusher rod 20 is held firmly in place by a top cap 13.

Figure 2:
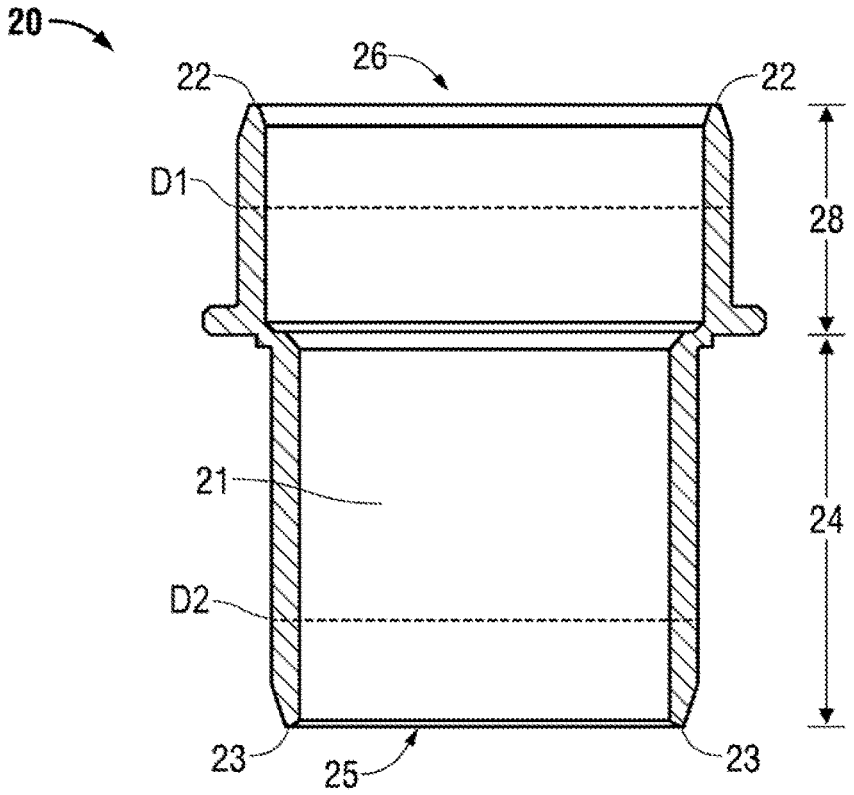
FIG. 2 depicts a cross-sectional view of one embodiment of a ball pusher.

Turning now to FIG. 2, the figure depicts a cross-sectional view of an embodiment of the pusher rod 20. The pusher rod 20 has a generally cylindrical shape with two ends 22, 23 connected by an internal bore 21 of the pusher rod 20, with the internal bore 21 of the pusher rod permitting fluid flow between upper end 22 and lower end 23. In one embodiment, the pusher rod has a double-ended funnel shape with the internal bore 21 angled outward toward the upper end 22 opening 26 for favorable fluid flow, and the internal bore 21 lower end 23 opening 25 angled outward to match a corresponding curved exterior contour of the ball 30, as shown in FIG. 1.

FIG. 2 illustrates an additional embodiment wherein the internal bore 21 has a lower section 24 that has a consistently smaller diameter D2 than the upper section 28 diameter D1.

Figure 3:
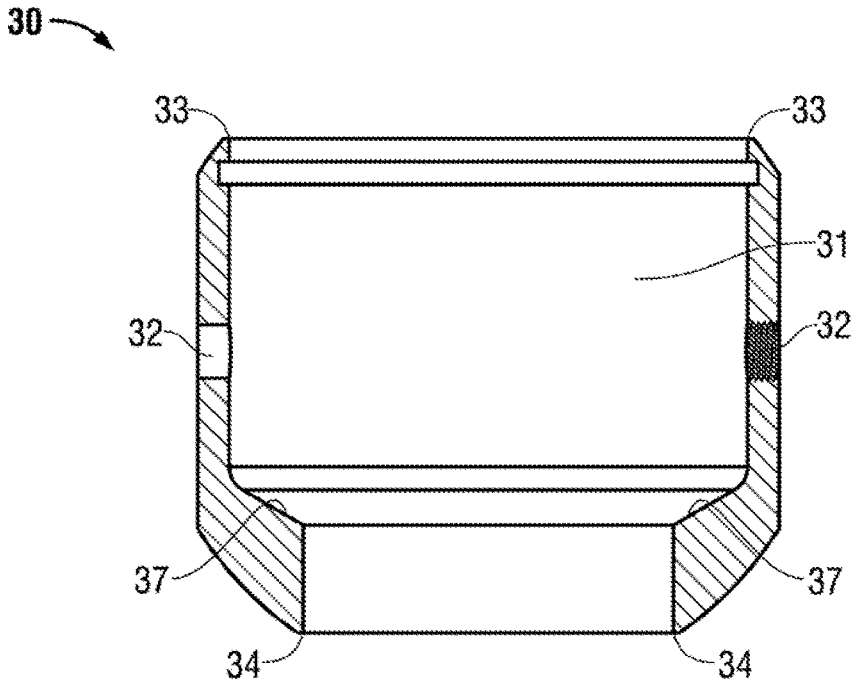
FIG. 3 depicts a cross-sectional view of one embodiment of a ball.

Turning now to FIG. 3, depicted is a close-up view of the ball 30. The ball 30 may be any device with rounded sections that can be made to pivot. The rotation of the ball 30 can seal off fluid flow by rotating the internal bore 31 of the ball away from the internal bore 21 of the pusher rod 20 based on fluid flow. The funnel shape of the lower end 23 of the internal bore 21 of pusher rod 20 allows a small amount of fluid flow through the pusher rod 20 to provide enough pressure to maintain constant, or at least sufficient, contact between the ball 30 and the pusher rod 20.

In the depicted embodiment, the ball 30 has an internal bore 31 for fluid flow and is pivotally mounted to housing 9 by mounts 32. In one embodiment, the mount is a hole for screws or bolts to be inserted that allow for rotational motion of the ball 30. In the embodiment shown in FIG. 3, the ball 30 comprises a curved interior diameter 37 for seating the pilot housing 2, as shown in FIG. 1, which may contain at least one and up to ten pilots 5 (shown as flappers) to allow one-way fluid flow through the ball 30. In the embodiment shown in FIG. 3, the upper end 33 of the internal bore 31 of the ball 30 has a larger interior diameter than the lower end 34 of the internal bore 31 of the ball 30. This design provides for favorable fluid flow in that a small amount of fluid flow can direct the ball 30 to rotate and align the internal bore 31 with the internal bore 21 of pusher rod 20, as described above.

Figure 4A:
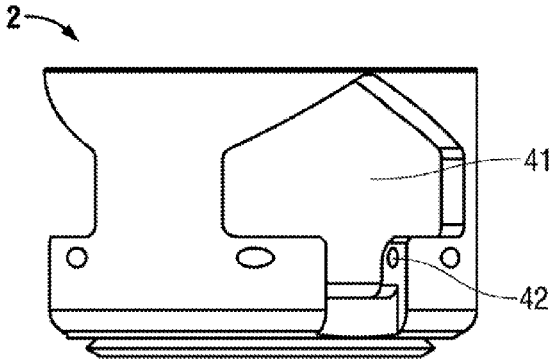
FIG. 4A is an exterior view of the pilot housing.
Figure 4B:
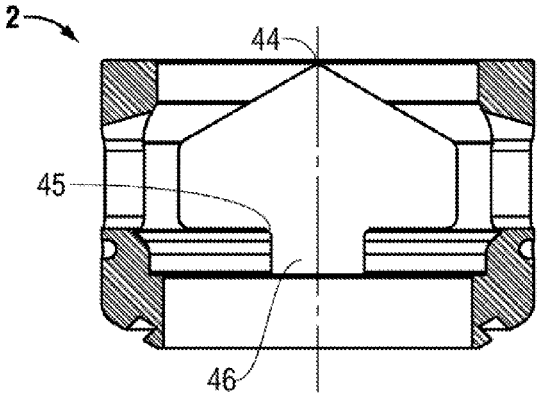
FIG. 4B is a cross-sectional view of the pilot housing with a flapper.
Figure 4C:
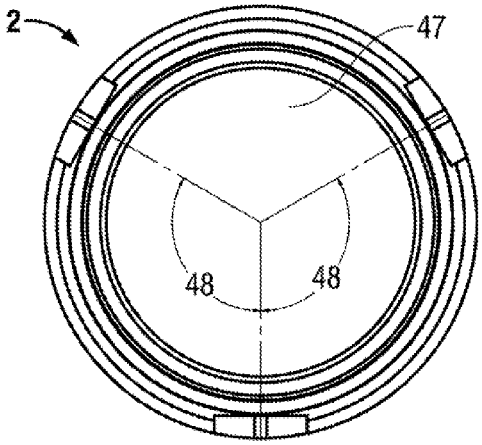
FIG. 4C is a plan view depicting the pilot housing and the interior bore.

Turning now to FIGS. 4A-4C, the figures illustrate different views of the pilot housing 2, which is designed to fit inside the ball 30. FIG. 4A is an exterior view of the pilot housing 2. In the embodiment shown, the pilot housing 2 has orifices 41 machined or cut out of the exterior for the pilot(s) 5, and holes 42 for pilot pins 3 to hold the pilots 5 which, in this example are flappers, to the pilot housing 2. The pilot(s) 5 can open and close using springs or other devices (not shown) that allow the pilot(s) 5 to selectively open with one-way fluid flow but close with no fluid flow or fluid flow in the other direction.

FIG. 4B is a cross-sectional view of the pilot housing 2 showing a pilot 5. In this embodiment shown in FIG. 4B, the pilot 5 has a point 44 on one end and a chamfer side 45 leading to base 46 that is attached to the pilot housing 2. FIG. 4C is a plan view showing the pilot housing 2 and the interior bore 47.

In the embodiment shown in FIG. 4C, three pilots 5 (shown as flappers) are utilized, with all three pilots 5 having equal size with an equal angle arrangement, wherein each pilot covers 120 degrees of the interior diameter radius 48 of the portion of the bore 47 in the pilot housing 2 aligned with the ball 30. This arrangement of pilots 5 can provide favorable flow control as each pilot covers an equal area, and can allow small changes in fluid flow to open and close the pilots 5, and also selectively rotate the ball 30. For example, pressure acting on a bottom section of the ball will rotate the ball 30 so that the internal bore 31 of the ball 30 is directed away from the internal bore 21 of the pusher rod 20 and/or the internal bore 47 of the housing 9, thus preventing fluid flow through the ball 30. The bottom section will typically be, for example, adjacent to the lower end 34 of the internal bore 31 of the ball 30, as shown in FIG. 3. However, depending on the rotation or pivot of the ball 30, the bottom section can be any section of ball 30 adjacent to the wellbore region below the ball 30.

Figure 4D:
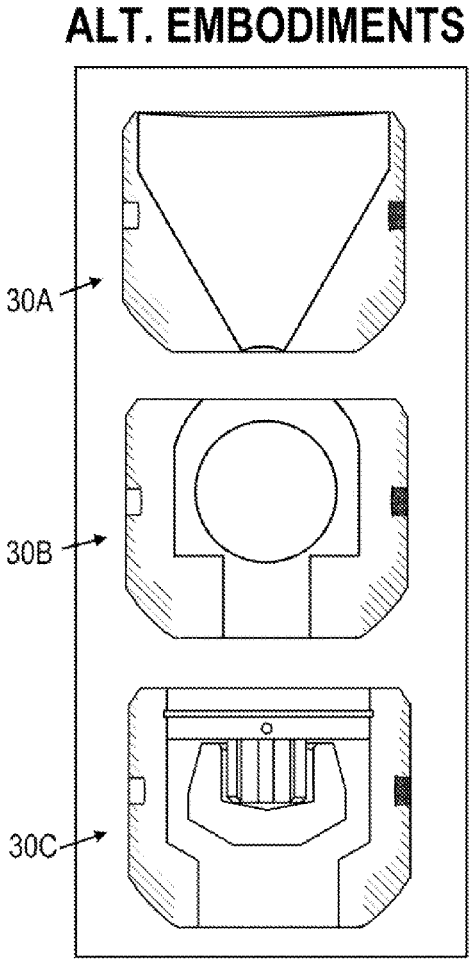
FIG. 4D is a cross-sectional view depicting alternative embodiments of the ball pilot apparatus.

Turning now to FIG. 4D, three alternative embodiments of the ball 30 are illustrated with different pilots. In these alternative embodiments, flow is controlled by choke 30A, secondary ball 30B, or poppet valve 30C. These alternative embodiments are not meant to be limiting, as it may of course be appreciated by those skilled in the art that any device or apparatus capable of restricting fluid flow may be used as a pilot 5 within ball 30.

Figure 5:
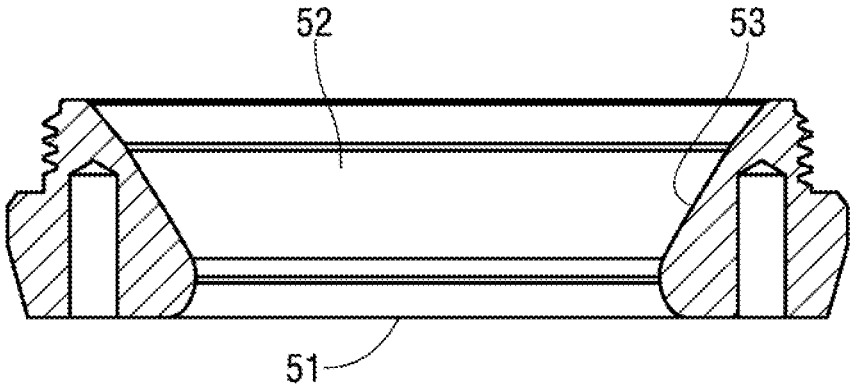
FIG. 5 is cross-sectional view depicting a ball stop.

FIG. 5 is cross-sectional view of a lower ball stop 1. As explained above, the lower ball stop 1 is designed to hold the ball 30 firmly in the housing 9 or tubular device. In the depicted embodiment, the ball stop 1 is designed to favorably handle contaminants and debris in the fluid flowing through the housing 9. As depicted, lower ball stop 1 comprises a bore 52 having a curved interior diameter 53. The curved interior diameter 53 of bore 52 preferably directs the fluid flow toward the opening 51 of bore 52 of ball stop 1 to help quickly remove any debris by directing or concentrating the fluid flow towards the opening 51 of bore 52. In addition, gaps 58 and curves 59 on the interior wall sections of the ball stop 1 can help direct debris toward the opening 51 of the bore 52, as shown in FIG. 1 and FIG. 5.

Figure 6:
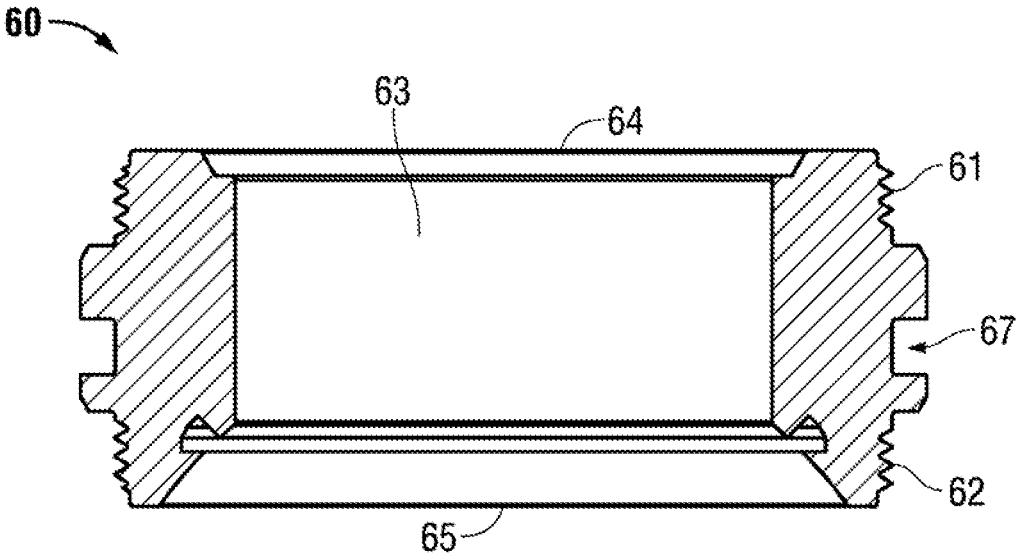
FIG. 6 is cross-sectional view depicting a seat section.

FIG. 6 is a cross-sectional view of a seat section 60 that can be either formed out of housing 9 or formed separately and inserted into housing 9. In the embodiment shown in FIG. 6, the seat device 60 is formed separately and screwed inside the housing with the use of top threads 61 and bottom threads 62. This seat shown is a cylinder with a bore 63 having an internal diameter with the upper end 64 designed to house the pusher rod 20 and the lower end 65 designed to house the ball 30. A groove 67 is shown that can be used to insert a sealing device, such as an O-ring, to further prevent fluid flow where the seat section 60 contacts the housing 9 (depicted in FIG. 1). In this embodiment, the seat section 60 is where the valve apparatus touches the interior of the housing 9 or tubular and is designed to prevent direct fluid flow outside of the interior of the valve. In addition, the groove 67 can prevent any fluid flow directly onto the seal within. This increases the life of the seal and improves valve apparatus reliability.

Material

The ball 30 may be made of any suitable material for use in a wellbore. In one embodiment, the material of the valve is chosen to be drillable. In particular, the material should be chosen to be easily drillable with an oil and gas drill bit, including a polycrystalline diamond compound (PDC) drill bit. A PDC drill bit has diamonds and special cutters and does not necessarily have rollers. In another embodiment, at least a majority of the material is composed of the same drillable material. Having only one material for the apparatus, or at least one material for the valve, allows for uniform expansion and contraction during high heat environments typically encountered in the course of well operations. Metal typically works well as a material, especially aluminum which has tolerance for high heat applications while also being easily drillable. In addition, the material should be easily formed, machined and/or millable to create the individual components, as described above. The material should be chosen to handle the wide range of pressures and temperatures experienced in a wellbore. Other suitable materials include, but are not limited to: plastics, cast iron, milled aluminum, steel, graphite composites, carbon composites or combinations thereof. Persons skilled in the art will recognize other materials that can be used in the makeup of the valve. The above list is not intended to be limiting and all such suitable materials are intended to be included within the scope in this invention.

Method

Figure 7:
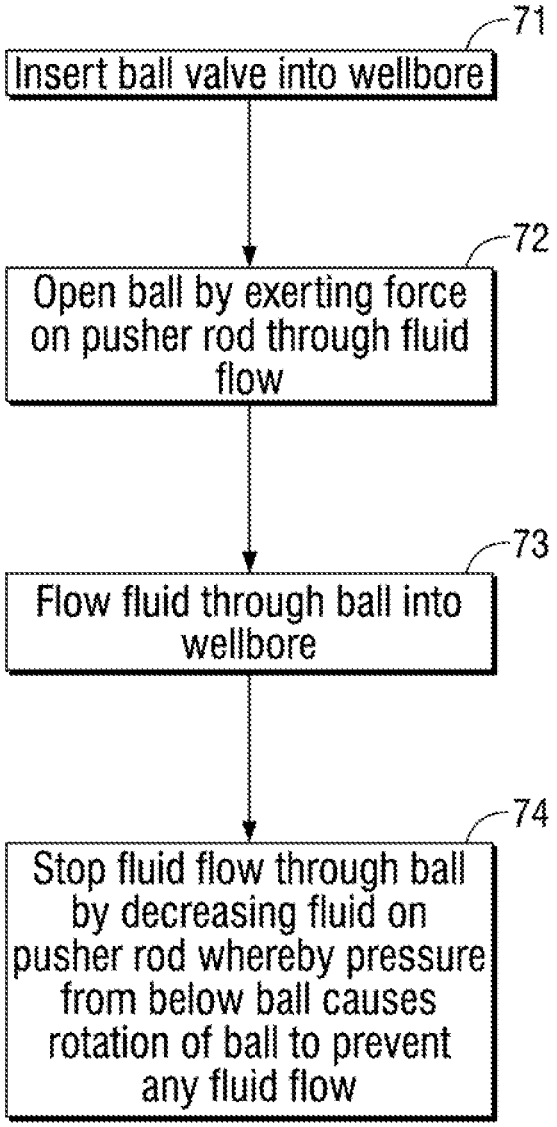
FIG. 7 is a flow chart illustration of a method embodiment.

FIG. 7 illustrates a flow chart of a method embodiment. As shown in FIG. 7, in one embodiment, the method comprises four steps. First, a ball with a pilot is inserted into a tubular in the wellbore 71. The ball pilot can include any apparatus described above that permits one-way fluid flow with a rotating valve that selectively facilitates one-way fluid flow based on pressure changes. Second, the ball is opened by exerting a force or pressure on the pusher rod through fluid flow 72. For example, this can occur through pumping fluids directly above the pusher rod. This enables fluid to be directed through the ball by aligning the internal bore of the pusher rod with the bore of the ball, and thus the pilot can allow one-way fluid flow. Third, fluid flows through the pilot into the wellbore below the tubular 73. This fluid flow can include, but is not limited to, casing mud, fracture fluid, acid treatments, and any combinations thereof. Finally, fluid flow is stopped 74. This can be accomplished by decreasing pressure (force) on the pusher rod by ceasing fluid pumping, and thus causing the ball to rotate, wherein the internal bore of the pusher rod is connected to the exterior surface of the ball. Back pressure in the wellbore will typically cause the ball to rotate when pumping above ceases. An operator can control or at least influence the pressure exerted on the ball through selective pumping of fluids.

A system embodiment can be provided by adding a control system to the apparatus described above. The control system can selectively control the opening and closing of the valve. The valve can be opened by exerting pressure on the pusher rod and closed by eliminating, or at least reducing, any pressure on the pusher rod. The pressure is typically controlled by fluid flow but can also be controlled by air pressure against the pusher valve. Persons skilled in the art, with the benefit of the disclosure above, will recognize many suitable control devices for controlling the valve in the system. All such control devices are intended to be within the scope of this invention.

While various embodiments usable within the scope of the present disclosure have been described with emphasis, it should be understood that within the scope of the appended claims, the present invention may be practiced other than as specifically described herein.

What is claimed is:

1. A valve for use in subterranean casing comprising:

a tubular housing comprising an inner surface and a bore for fluid flow inside the tubular housing;

a ball comprising an upper end, a lower end, an internal bore extending from the upper end to the lower end, and a rounded external contour, wherein the upper end of the ball comprises a larger interior diameter than the lower end of the ball, and wherein the ball is sized to rotate within the tubular housing;

at least one pilot located inside the internal bore of the ball, wherein the at least one pilot permits fluid flow in one direction;

a seat located along the bore of the tubular housing, wherein the seat prevents fluid flow between the ball and the tubular housing; and a pusher rod comprising a cylindrical shape, a first end, a second end, and an internal bore connecting the first end and the second end, wherein the first end and the second end each comprise an opening, wherein the internal bore comprises an internal diameter, wherein the first end opening is angled outward with the internal diameter increasing toward the first end opening and the second end opening is angled outward, wherein the internal diameter of the second end opening substantially matches a corresponding exterior contour of the ball and the second end opening is adjacent the upper end of the ball to permit fluid flow in the one direction, and wherein the second end is rounded to substantially match the corresponding exterior contour of the ball, wherein rotation of the internal bore of the ball away from the internal bore of the pusher rod prevents fluid flow through the internal bore of the ball, and rotation of the bore of the ball towards the internal bore of the pusher rod permits fluid flow in the one direction through the internal bore of the pusher rod and the internal bore of the ball, and wherein the pusher rod and the inner surface of the tubular housing comprise at least one seal preventing fluid flow between the pusher rod and the inner surface of the tubular housing.

2. The valve of claim 1, wherein the tubular housing is a float collar within a casing string.

3. The valve of claim 1, wherein the at least one seal is an O-ring seal.

4. The valve of claim 1, wherein the fluid flow through the internal bore of the pusher rod and the internal bore of the ball does not directly impact the seat.

5. The valve of claim 1, wherein the fluid flow is in the one direction through the internal bore of the pusher rod and the internal bore of the ball does not directly impact the at least one seal.

6. The valve of claim 1, wherein the pilot is a flapper valve, selective membrane, one-way valve, poppet valve, a secondary ball in ball valve, pressure valve, or combinations.

7. The valve of claim 1, wherein the rotation of the ball is selectively controlled by fluid flow, pressure or combinations thereof.

8. The valve of claim 1, wherein a portion of the ball is located below the seat, and wherein the pusher rod extends from the ball through the seat, thereby directing fluid flow above the seat through the ball.

9. The valve of claim 1, wherein the pusher rod exerts selective pressure on the ball, thereby preventing any fluid flow from contacting the seat, a seal, or combinations thereof.

10. A method for controlling fluid flow inside a wellbore device comprising the steps of:

inserting a tubular device with a bore for fluid flow into the wellbore, the tubular device comprising a ball and a pusher rod, the ball and the pusher rod each comprising an internal bore and an exterior surface, the ball comprising an upper end and a lower end on opposite sides of the internal bore of the ball, the upper end of the ball comprising a larger interior diameter than the lower end of the ball;

opening the ball by exerting pressure on the pusher rod to enable fluid flow through the ball, wherein the internal bore of the pusher rod is aligned with the internal bore of the ball and the pusher rod is adjacent the upper end of the ball; and allowing fluid flow through a pilot located inside the internal bore of the ball, and into the wellbore below the tubular device, wherein the pilot permits fluid flow in one direction; and stopping fluid flow through pressure from below the ball acting on a bottom section of the ball, thereby causing internal pressure on the ball to rotate the ball such that the internal bore of the pusher rod is aligned with the exterior surface of the ball.

11. The method of claim 10, wherein the step of exerting or decreasing pressure on the pusher rod is influenced through a control device, wherein the control device exerts pressure through fluid flow opening of the pilot within the internal bore of the ball, and decreases pressure through the exertion of pressure on the bottom section of the ball from beneath the ball.

12. The method of claim 10, further comprising providing at least one seal between the exterior surface of the pusher rod and the bore of the tubular device.

13. The method of claim 12, wherein fluid flow bypasses the at least one seal.

14. The method of claim 10, wherein an end of the pusher rod is contoured to match a contour of the exterior surface of the ball.

15. The method of claim 10, wherein the step of exerting pressure on the ball with the pusher rod prevents any direct fluid flow external to the respective internal bores.

16. A fluid flow system for controlling fluid flow movement inside well tubulars inside a wellbore, the fluid flow system comprising:

a tubular housing comprising an inner surface and a bore for fluid flow inside the tubular housing;

a ball comprising an upper end, a lower end, a bore extending from the upper end to the lower end, and a rounded external contour, wherein the upper end of the ball comprises a larger interior diameter than the lower end of the ball, and wherein the ball is sized to rotate within the tubular housing;

at least one pilot located inside the internal bore of the ball, wherein the at least one pilot permits fluid flow in one direction;

a pusher rod comprising a cylindrical shape, a first end, a second end, and an internal bore connecting the first end and the second end, wherein the first end and the second end each comprise an opening, wherein the internal bore comprises an internal diameter, and wherein the pusher rod is adjacent the upper end of the ball to permit fluid flow in the one direction;

at least one seal between the pusher rod and the internal surface of the tubular housing to prevent fluid flow from directly contacting a seat between the ball and the inner surface of the tubular housing; and a control device that controls the rotation of the ball through actuation of the pilot through fluid flow, force exerted on the pusher rod, pressure exerted on a bottom section of the ball, or combinations thereof, and wherein rotation of the bore of the ball away from the internal bore of the pusher rod prevents fluid flow through the ball and rotation of the bore of the ball in alignment with the internal bore of the pusher rod permits one-way fluid flow.

17. The system of claim 16, wherein the at least one seal between the pusher rod and the inner surface of the tubular housing is inside a groove on the pusher rod.

18. The system of claim 17, wherein the at least one seal is an O-ring.

19. The system of claim 17, wherein fluid flow bypasses the at least one seal.

20. The system of claim 16, wherein the internal diameter of the internal bore increases towards the second end opening to match the rounded exterior contour of the ball.

* * * * *